United States Patent [19]

Yamanaka

[11] 4,415,787

[45] Nov. 15, 1983

[54] VACUUM INTERRUPTER

[75] Inventor: Takashi Yamanaka, Amagasaki, Japan

[73] Assignee: Mitsubishi Denki Kabushiki Kaisha, Tokyo, Japan

[21] Appl. No.: 246,639

[22] Filed: Mar. 23, 1981

[30] Foreign Application Priority Data

Dec. 22, 1980 [JP] Japan ..... 55-182216
Dec. 23, 1980 [JP] Japan ..... 55-183117

[51] Int. Cl.[3] ..... H01H 9/32

[52] U.S. Cl. ..... 200/144 B; 200/262; 200/147 R

[58] Field of Search ..... 200/144 B, 154, 237, 200/262-270, 147 R

[56] References Cited

U.S. PATENT DOCUMENTS 2,949,520 8/1960 Schneider ..... 200/144 B
3,852,555 12/1974 Schuocker et al. ..... 200/144 B
3,946,179 3/1976 Murano et al. ..... 200/144 B
4,196,327 4/1980 Kurosawa et al. ..... 200/144 B

FOREIGN PATENT DOCUMENTS 2429484 8/1976 Fed. Rep. of Germany .
55-8775 3/1980 Japan .
2038557 8/1980 United Kingdom .

*Primary Examiner*—Thomas J. Kozma
*Assistant Examiner*—Morris Ginsburg
*Attorney, Agent, or Firm*—Oblon, Fisher, Spivak, McClelland & Maier

[57] ABSTRACT

A vacuum interrupter for opening and closing a current passage comprises a pair of electrodes which are detachable and respectively connected to each of conductive rods in a vacuum container, wherein each of said electrodes comprises one or more grooves to cut the peripheral part of the electrode at one end and to approach the other end near the peripheral part of the electrode to form a current passage and also each current conductor connecting electrically said electrode to said conductive rod near the cut part of said electrode deviated from the center of said electrode, whereby a magnetic field in parallel to the arc between said pair of electrodes is formed.

15 Claims, 33 Drawing Figures

FIG. 1(a)
PRIOR ART
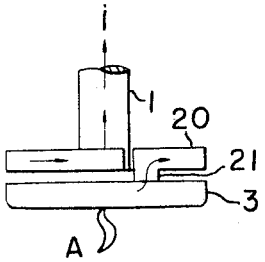
FIG. 2(a)
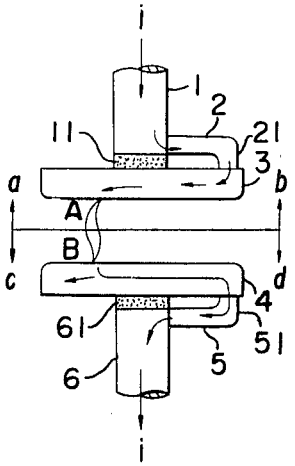
FIG. 2(b)
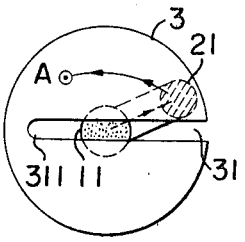
FIG. 1(b)
PRIOR ART
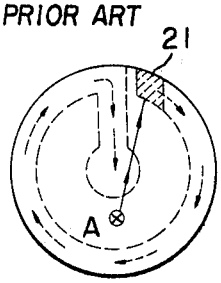
FIG. 2(c)
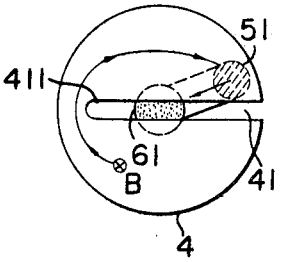
FIG. (a)
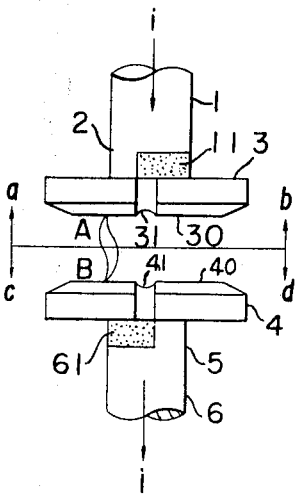
FIG. 3(b)
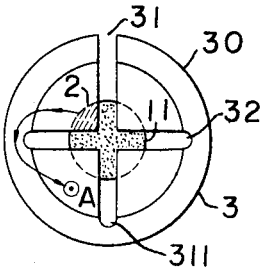
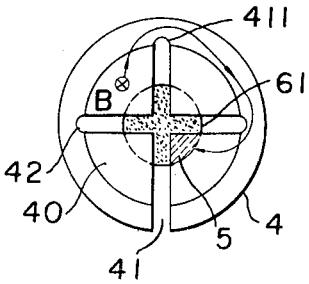
FIG. 3(c)

FIG. (6c)

VACUUM INTERRUPTER

BACKGROUND OF THE INVENTION

1. Field of the Invention

The present invention relates to a vacuum interrupter having an adverse effect of an eddy current.

2. Description of the Prior Art

It has been well known that an interruption characteristic is improved by applying a vertical magnetic field in parallel to an arc of a vacuum interrupter.

FIGS. 1(*a*), (*b*) is a schematic view of a conventional vacuum interrupter showing the principle of a structure of an electrode wherein the reference numeral (1) designates a conductive rod; (20) designates a coil electrode which has an arm projected radially from a base of the conductive rod (1) and which continues through one coil twin and is connected by means of a connection (21) to a main electrode (3). The coil electrode (20) is shown in the form of the one turn-coil, however, plural coil electrodes (20) can be provided in the back side of the main electrode (3). The reference (A) designates an arc formed between the main electrode and a counter electrode (not shown) and the reference (i) designates a current resulted by the arc and the direction of the current is shown by the arrow line. The aforementioned elements are vacuum tightly installed in a vacuum container (not shown) so that each other end of the conductive rods extend exterior to the container.

The operation of the conventional interrupter will be illustrated. The arc (A) is formed on the main electrode (3) and the current (i) is fed through the connection (21) and the one turn-coil formed by the coil electrode (20) to the conductive rod (1) whereby a magnetic field in parallel to the arc (A) is generated. It has been considered that the arc having a low arc voltage and uniform distribution can be obtained by the interaction between the magnetic field and the arc.

Because of the above-mentioned structure of the electrodes, a reinforcing part for spacing the main electrode (1) and the coil electrode (20) is needed and the coil electrode (20) must have a rigid structure to be durable to an electromagnetic force caused by the large current and a mechanical shock caused in the switching whereby a large thickness unnecessary for electrical purposes is required for the coil electrode which is usually made of copper having high conductivity. The magnetic field generated by the coil electrode is perpendicular to the main electrode (3) whereby an eddy current is passed in the main electrode (3) to reduce the magnetic field generated by the coil electrode (20) by the magnetic flux in the reverse direction caused by the eddy current. The desired results have not been attained. Thus, in the conventional practical vacuum interrupter, many grooves for eddy current prevention are formed on the main electrode (3) to cause inferior mechanical strength of the main electrode. Therefore, a reinforcing part made of a non-magnetic high resistant metal is needed. The two layer structure of the main electrode and the coil electrode with the reinforcing part should have high accuracy and accordingly, the fabrication and the fixing process are complicated causing great expense. In spite of the complicated and expensive structure, the effect of the electrodes is not satisfactory. The intensity of the magnetic field is reduced for the distance of the coil electrode from the surface of the main electrode which generates the arc because the coil electrode is formed on the back side of the main electrode. In order to give the intensity of the magnetic field required for the arc, it is necessary to generate the magnetic field having high intensity by the coil electrode. Therefore, the adverse effects of the electromagnetic force and the eddy current are severe. The serious disadvantages have been found.

SUMMARY OF THE INVENTION

It is an object of the present invention to overcome the disadvantages of the conventional vacuum interrupter and to provide a vacuum interrupter having an economical electrode structure which has excellent interruption characteristic and mechanical strength without an adverse effect of an eddy current and without a coil electrode, in which a groove is formed on an electrode to pass a current through a current passage partitioned by the groove and to form a magnetic field parallel to an arc by the electrode near the arc.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1(*a*) is a side view of the principal electrode structure of a conventional vacuum interruptor;

FIG. 1(*b*) is a plane view of the principal electrode structure of a conventional vacuum interruptor;

FIG. 2(*a*) is a side view of a pair of electrodes of a vacuum interruptor according to one embodiment of the present invention;

FIG. 2(*b*) is a plane view of the pair of electrodes of FIG. 2(*a*) in the a–b arrow direction;

FIG. 2(*c*) is a plane view of the pair of electrodes of FIG. 2*a* in the c–d arrow direction;

FIG. 3*a* is a side view of a pair of electrodes of the vacuum interruptor according to another embodiment of the present invention;

FIG. 3(*b*) is a plane view of the pair of electrodes of FIG. 3*a* in the a–b arrow direction;

FIG. 3(*c*) is a plane view of the pair of electrodes of FIG. 3(*a*) in the c–d arrow direction;

FIG. 4(*b*) is a plane view of the electrodes of FIG. 4(*a*) in the a–b arrow direction;

FIG. 4(*c*) is a plane view of the electrodes of FIG. 4(*a*) in the c–d arrow direction;

FIG. 5(*b*) is a plane view of the electrodes of FIG. 2(*a*) in the a–b arrow direction showing still another alternate groove configuration of the electrode;

FIG. 5(*c*) is a plane view of the electrodes of FIG. 2(*a*) in the a–b arrow direction illustrating still another groove configuration of the electrode;

FIG. 6(*b*) is a plane view of the electrodes of FIG. 6(*a*) in the a–b arrow direction;

FIG. 6(*c*) is a plane view of the electrodes of FIG. 6(*a*) in the c–d arrow direction;

FIG. 7(*b*) is a plane view of another embodiment of the electrodes of FIG. 6(*a*) in the c–d arrow direction;

FIG. 8(*b*) is a plane view of another embodiment of the electrodes of FIG. 6(*a*) in the c–d arrow direction;

FIG. 9(*b*) is a plane view of the electrodes of FIG. 9(*a*) in the a–b arrow direction;

FIG. 9(*c*) is a plane view of the electrodes of FIG. 9(*a*) in the c–d arrow direction;

FIG. 10(*b*) is a plane view of the electrodes of FIG. 10(*a*) in the a–b arrow direction;

FIG. 10(*c*) is a plane view of the electrodes of FIG. 10(*a*) in the c–d arrow direction;

FIG. 11(*b*) is a plane view of the electrodes of FIG. 11(*a*) in the a–b arrow direction;

FIG. 11(*c*) is a plane view of the electrodes of FIG. 11(*a*) in the c–d arrow direction;

FIG. 12(*b*) is a plane view of the electrodes of FIG. 12(*a*) in the a–b arrow direction;

FIG. 12(*c*) is a plane view of the electrodes of FIG. 12(*a*) in the c–d arrow direction.

DETAILED DESCRIPTION OF THE PREFERRED EMBODIMENTS

Figure 4A:
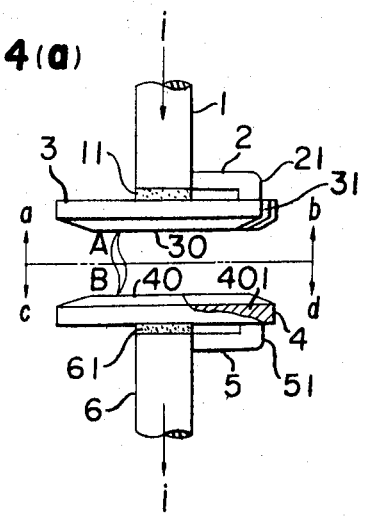
FIG. 4(*a*) is a side view of a pair of electrodes of the vacuum interruptor according to still another embodiment of the present invention.

Referring to the drawings, one embodiment of the present invention will be illustrated.

FIG. 2(*a*) is a side view of a pair of electrodes; FIG. 2(*b*) is a plane view in the arrow direction of a–b (hereinafter referring to (a–b) arrow view) and FIG. 2(*c*) is a plane view in the arrow direction of c–d (hereinafter referring to (c–d) arrow view).

In the drawings, the reference numerals (1) and (6) respectively designate each conductive rod which is mechanically connected through each reinforcing part (11) or (61) made of a high resistant metal such as stainless steel to each electrode (3) or (4). Each current conductor (2) or (5) is electrically connected from the base of each conductive rod (1) or (6) through each connecting part (21) or (51) to each electrode (3) or (4) under maintaining the below-mentioned positions. Each groove (31) or (41) is formed on each electrode (3) or (4) to pass through the center of the electrode in the full thickness to cut one peripheral portion of the electrode and to approach the other end (311) or (411) near the other peripheral portion of the electrode.

Usually, one of the pair of the electrodes is a stationary electrode and the other is a movable electrode in a vacuum interrupter. In the drawing, the upper electrode shown by the (a–b) arrow view is the stationary electrode and the lower electrode shown by the (c–d) arrow view is the movable electrode. In view of the function, the relation is not critical. The pair of the electrodes (3), (4) are placed to face the grooves (31), (41) in the same direction. The conductor (2) or (5) is electrically connected to the back surface of the electrode by the connecting part (21) or (51) near the part cutting the peripheral part of the electrode by the groove (31) or (41). The connection of the conductors (2), (5) are selected so as to prevent the superposition of the connecting parts (21), (51) with each other.

In the structure of the electrodes, when the arc A–B is generated between the electrodes (3), (4) by the current i, the current i passes as shown by the arrow lines in FIGS. 2(*a*), (*b*), (*c*) from the conductive rod (1) in the stationary side through the current conductor (2) and the connecting part (21) to the electrode (3). In the electrode (3), the current passes through the connecting part (21) to the arc point A. The current further passes through the arc plasma to the arc point B of the other counter electrode (4). The current passes from the arc point B through the part between the end (411) of the groove (41) and the peripheral part of the electrode and the connecting part (51) and the current conductor (5) to the conductive rod (6). The passage of the current i passing through the electrodes (3), (4) as (21)→A and B→(51) is in a form of one turn coil whereby a magnetic flux in parallel to the arc A–B is formed. The intensity of the magnetic field is remarkably high because it is formed by the current passing through the electrodes near the arc. The eddy current by the grooves (31), (41) can be effectively reduced. Therefore, it provides the stable arc having uniform distribution which is superior to the arc resulted by the conventional device. The adverse effect of the magnetic field caused by the eddy current in the conductive rod (6) to the electrode (3) can be eliminated by selecting a large thickness of the reinforcing part (61). Therefore, the lagging of the vertical magnetic field at the zero current point is reduced to effectively prevent the erroneous rearcing.

Moreover, a coil electrode required in the conventional device can be eliminated whereby the structure can be remarkably simple and can have high mechanical strength without any trouble of the eddy current.

In accordance with the structure of the electrodes of the present invention, the current passing through the inner parts of the electrodes in the closed state, is in the same direction for both electrodes whereby the electrodes are attracted to each other by the electromagnetic attractive force resulted by the current passing in parallel to improve the pressure for contacting the electrodes. Therefore, the contacting force which is externally applied can be remarkably reduced in comparison with the conventional device.

Figure 4B:
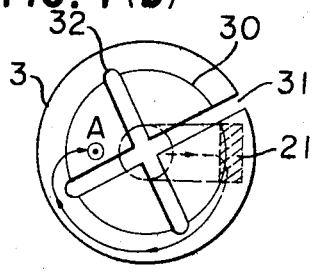
Figure 4C:
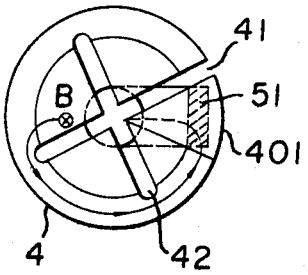

In the above-mentioned embodiment, the structure having one groove is shown. The configuration of the grooves can be modified as shown in FIGS. 3 to 5(*a*), (*b*), (*c*).

Figure 5A:
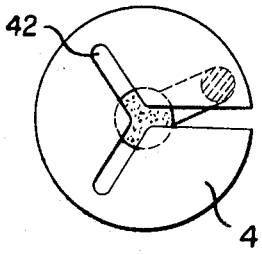
FIG. 5(*a*) is a plane view of the electrodes of FIG. 2(*a*) in the a–b arrow direction showing an alternate groove configuration.
Figure 5B:
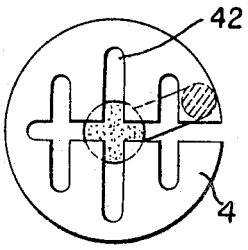
Figure 5C:
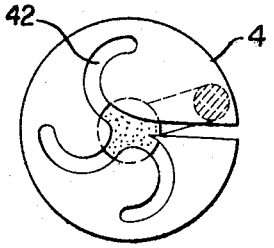

It is possible to have branch grooves (42) in the form equally divided at the center of the electrode as shown in FIG. 5(*a*). In this embodiment, the current passage is shifted to the peripheral part from the passage in the embodiment of FIG. 2. Therefore, the current passage in the coil form can be further improved.

It is possible to have plural crossed grooves (42) as shown in FIG. 5(*b*). The current passage in the coil form is also improved as the embodiment of FIG. 5(*a*).

It is possible to have plural spiral grooves extending from the center to the peripheral parts of the electrode as shown in FIG. 5(*c*). When the connecting part of the current conductor is provided in the side of the spiral turn of the grooves, the current passage is in a form of smooth arch whereby the uniform magnetic field is formed.

In the embodiments, the current conductor (2) or (5) in the form of arm is connected to the conductive rod (1) or (6).

It is possible to attain the same effect by the embodiment shown in FIGS. 3(*a*), (*b*), (*c*) wherein an eccentric projecting current conductive base (2) or (5) provided on the end of the conductive rod (1) or (6) is connected to only one part of the trapezoidal electrode part divided by the grooves (31), (32) or (41), (42) which cross at the center and an auxiliary part (11) or (61) made of a high resistant metal is placed in the space therebetween.

In the embodiment, it is possible to form the electrode which has a conical shape having flat circular top (30) or (40) and has grooves whose ends (311), (411) are on the slant conical surface whereby the arcing point can be selected out of the narrow gaps between the ends and the peripheral part having small heat capacity therein.

In these embodiments, the grooves of the pair of the electrodes are superposed to place the connecting parts (21), (51) of the current conductors (2), (5) in the opposite sides across the grooves.

It is possible to attain the same effect by the embodiment shown in FIG. 4 wherein the connecting parts (21), (51) of the current conductors (2), (5) are superposed to deviate the positions of the grooves (31), (32) and (41), (42). In this embodiment, when the arcing initiates on the surface of the connecting parts (21), (51) in the electrode surface side, the coil form does not allow current passage and the desired effect can not be given. Therefore, a concave (401) is preferably formed to form the non-contacting part near the parts in one electrode surface side.

In accordance with the vacuum interrupter of the present invention, the groove is formed on each electrode to pass the current for arching through the passage given by the groove thereby forming the magnetic field in parallel to the arc near the arc. Therefore, the mechanical and electrical characteristics of the vacuum interrupter can be remarkably improved.

The other embodiment of the present invention will be illustrated.

Figure 6A:
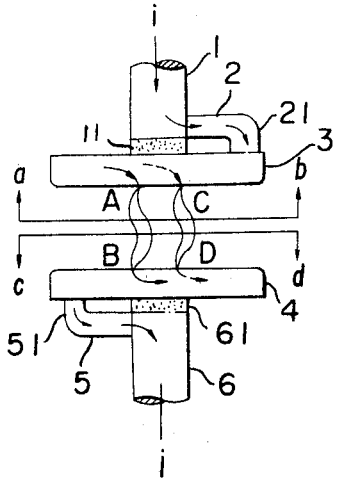
FIG. 6(*a*) is a side view of a pair of electrodes according to another embodiment of the present invention.
Figure 6B:
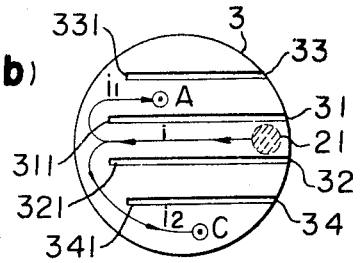
Figure 6B:
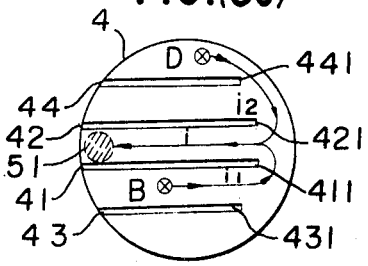

FIG. 6(*a*) is a side view of the pair of electrodes and FIG. 6(*b*) is (a–b) arrow view and FIG. 6(*c*) is (c–d) arrow view. The reference numerals (1) and (6) respectively designate each conductive rod which is mechanically connected to each electrode (3) or (4) through each reinforcing part (11) or (61) made of a high resistant metal such as stainless steel. Each current conductor (2) or (5) is electrically connected from the base of each conductive rod (1) or (6) through each connecting part (21) or (51) to each electrode (3) or (4). They are placed to be symmetric positions to the center of the axis of the electrodes. Grooves (31), (32), (33), (34), (41), (42), (43), (44) are formed in parallel on the electrodes (3), (4) in the full thickness to cut the peripheral parts of the electrode in one end and to approach each of the other ends (311), (321), (331), (341), (411), (421), (431), (441) to the peripheral part of the electrode. The grooves are formed on the electrodes (3), (4) in the reverse direction. As shown in the (a–b) arrow view of FIG. 6(*b*) and the (c–d) arrow view of FIG. 6(*c*), both electrodes (3), (4) have the same structure, however the electrodes are placed in the reverse direction for 180 degree to the center of the electrodes.

In the structure of the electrodes, when the arcs are generated between the arc points A–B and the arc points C–D of the electrodes (3), (4) by the current i, the current i passes as shown by the arrow lines in FIGS. 6(*a*), (*b*), (*c*) from the conductive rod (1) through the current conductor (2) and the connecting part (21) to the electrode (3). The current i further passes through the guide passage partitioned by the grooves (31), (32) to the peripheral part of the electrode (3) at the opposite side and the current i is divided into the current $i_1$ for the arc point A and the current $i_2$ for the arc point C. The current $i_1$ passes through the guide passage partitioned by the grooves (31), (33) to the arc point A and passes across the arc plasma to the arc point B of the other electrode (4). The current $i_1$ passes from the arc point B through the guide passage partitioned by the grooves (41), (43) to the end (411) of the groove (41). At the end (411), the current $i_1$ is combined with the current $i_2$ passed through the other passages and the combined current passes through the passage partitioned by the grooves (41), (42) to the connecting part (51) and further passes through the current conductor (5) to the electrode (6). The passage of the current $i_1$ as (21)→(311)→A.B→(411)→(51) and the passage of the current $i_2$ as (21)→(321)→C.D→(441)→(421)→(51) respectively form each 1–1.5 turn coil form whereby each magnetic field is formed in parallel to each of the arc. The intensity of the magnetic field is remarkably high because it is formed by the current passing through the electrodes near the arc. It provides the stable arc having uniform distribution. The magnetic field is formed along the grooves and the eddy current is effectively reduced by the grooves whereby it is unnecessary to provide a special consideration for reducing an eddy current as required in the conventional device.

In accordance with the structure of the electrodes of the present invention, the currents in the pair of the electrodes in the closing, are in the same direction in both of the passage partitioned by the grooves (31), (32) and the passage partitioned by the grooves (41), (42) whereby the electrodes are mutually attracted by the electromagnetic attractive force resulted by the current passing in parallel to improve the pressure for contacting the electrodes. Therefore, the contacting force which is externally applied can be remarkably reduced in comparison with the conventional device.

Figure 7A:
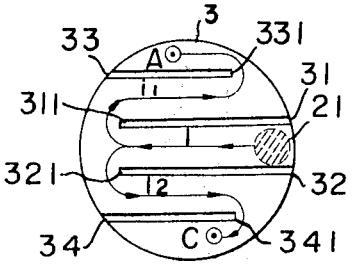
FIG. 7(*a*) is a plane view of another embodiment of the electrodes of FIG. 6(*a*) in the a–b arrow direction.
Figure 7B:
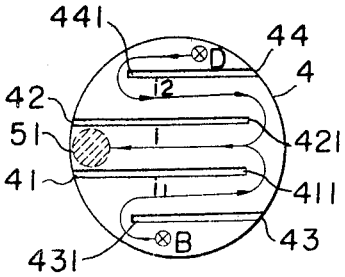

In the above-mentioned embodiment, the grooves on the electrodes are formed in the same direction. It is possible to attain the same effect by forming grooves in the opposite directions for the grooves (31), (33) and for grooves (32), (34) as shown in FIG. 7(*a*), (*b*). In the embodiment, the direction of the magnetic field formed between the grooves (31), (41) is opposite to the direction of the magnetic field formed between the grooves (33), (43). FIG. 7(*a*) corresponds to the (a–b) arrow view of FIG. 6(*a*) and FIG. 7(*b*) corresponds to the (c–d) arrow view of FIG. 6(*a*).

Figure 8A:
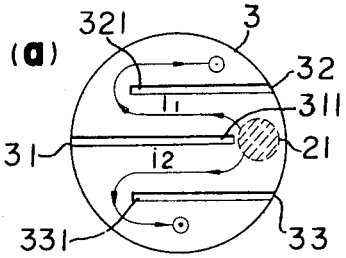
FIG. 8(*a*) is a plane view of another embodiment of the electrodes of FIG. 6(*a*) in the a–b arrow direction.
Figure 8B:
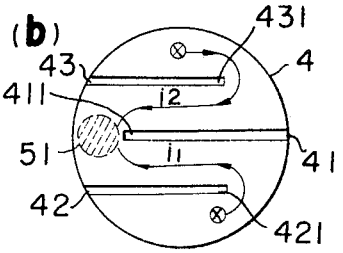

It is possible to attain the same effect by connecting each connecting parts (21) or (51) to each part between the peripheral part and each of the ends (311), (411) of the grooves (31), (41) as shown in FIG. 8(*a*), (*b*). In the embodiment, the electromagnetic attractive force in the current passage at the center is slightly smaller, however, the magnetic field in parallel to the arc is not formed only between the central grooves (31), (41) but the magnetic field is formed near the parts.

In these embodiments, the current conductors (2), (5) and the grooves (31), (41) . . . , are placed in the same direction.

Figure 9A:
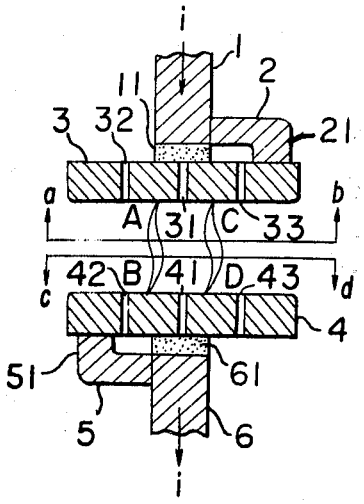
FIG. 9(*a*) is a side view of a pair of electrodes according to another embodiment of the present invention.
Figure 9B:
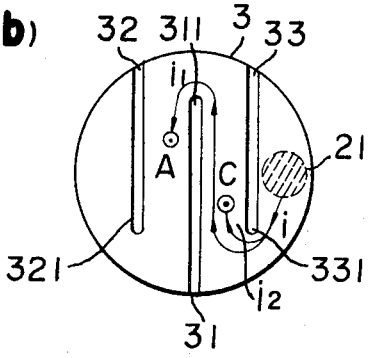
Figure 9C:
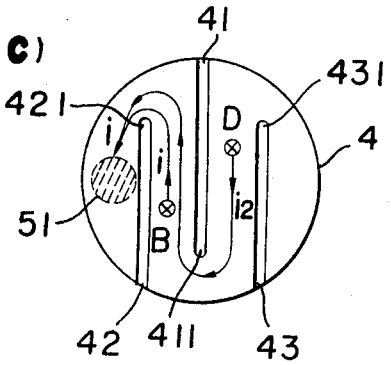

It is possible to attain the same effect by placing the current conductors (2), (5) in perpendicular to the grooves (31), (32), (33), (41), (42), (43) as shown in FIGS. 9(*a*), (*b*), (*c*). In the embodiment, all the current is passed through the passages partitioned by the grooves and accordingly the electromagnetic attractive force and the intensity of the magnetic field are remarkably large.

Figure 10A:
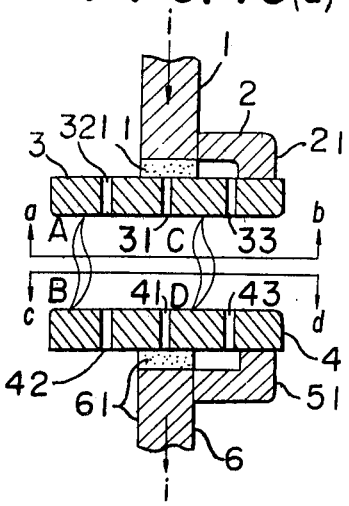
FIG. 10(*a*) is a side view of a pair of electrodes according to another embodiment of the present invention.
Figure 10B:
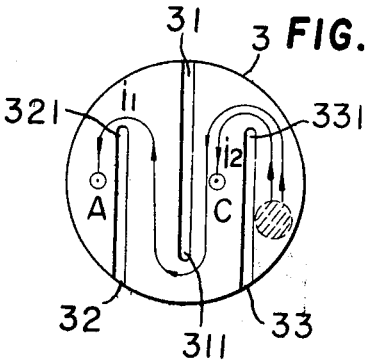
Figure 10C:
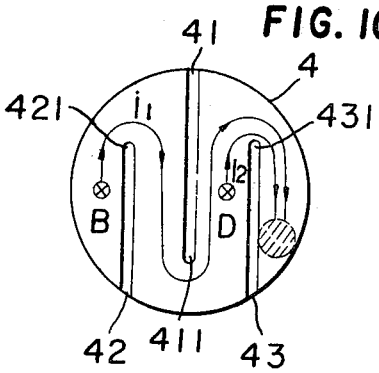
Figure 11A:
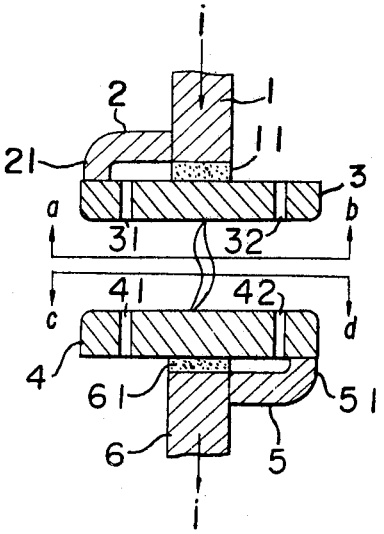
FIG. 11(*a*) is a side view of a pair of electrodes according to another embodiment of the present invention.
Figure 12A:
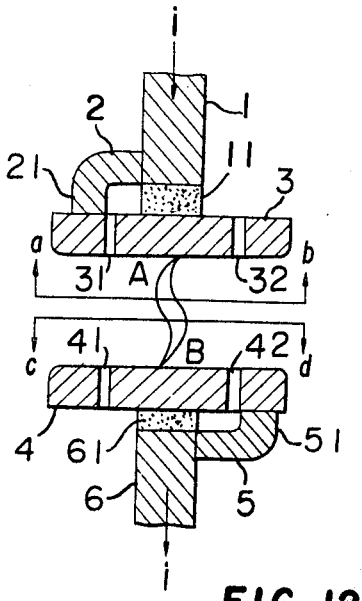
FIG. 12(*a*) is a side view of a pair of electrodes according to another embodiment of the present invention.
Figure 11B:
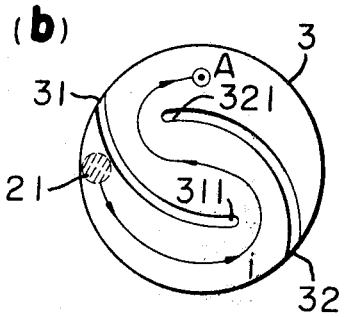
Figure 12B:
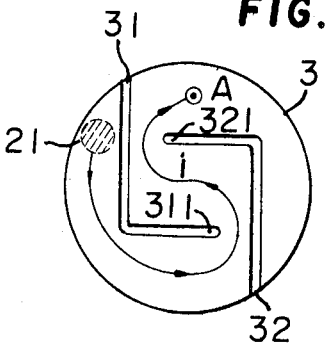
Figure 11C:
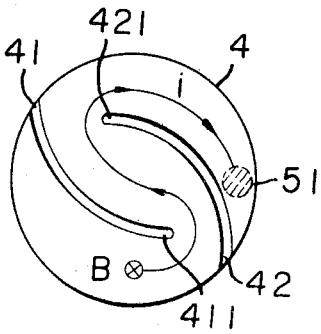
Figure 12C:
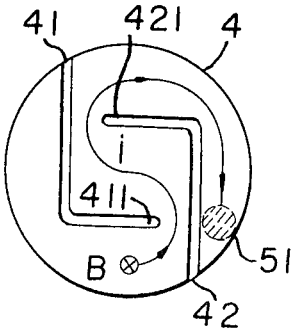

The same effect is also attained by the structure shown in FIGS. 10, 11 and 12.

In the embodiment of FIG. 10, the current conductors (2), (5) are placed in the same direction. In the embodiment of FIG. 11, the grooves are formed in a curved form having a desired curvature. In the embodiment of FIG. 12, the straight rectangular grooves are formed. The other structure is the same as the embodiment of FIG. 9. In these embodiments, the magnetic field is formed in parallel to the arc generated between the electrodes to attain the same effect.

In accordance with the vacuum interrupter of the present invention, the groove is formed on each electrode to pass the arc current through the passages defined by the grooves to form the magnetic field in parallel to the arc near the arc whereby the mechanical and electrical characteristics can be remarkably improved.

In the embodiments, the grooves can be filled with an insulating material if desired.

I claim:

1. An electric circuit interrupter, comprising:

a pair of conductive rods;

a pair of opposed separable electrodes, each said electrode mechanically connected to a respective rod;

said pair of conductive rods movable relative to each other from a position in which said pair of electrodes are in contact with each other to a position in which said pair of electrodes are out of contact with each other whereby an arc is formed between said pair of electrodes;

a current conductor connecting electrically at least one of said conductive rods to a respective electrode at a point deviated from the center thereof; and, at least one of said electrodes having at least one groove cut therethrough, said at least one groove having one end cutting through a peripheral part of the electrode and another end extending towards another peripheral part of the electrode to form a current passage in the form of at least one coil turn passing through the electrode partially partitioned by the groove, whereby a magnetic field is formed in parallel to the arc between said pair of electrodes;

each said electrode connected to a respective conductive rod through a reinforcing material for reinforcing the mechanical connection therebetween and for preventing an eddy current in each said electrode.

2. An electric circuit interrupter according to claim 1, wherein said current conductor is connected near the peripheral part of said electrode cut through by said groove.

3. An electric circuit interrupter according to claim 2, wherein the groove is formed through the center of said electrode.

4. An electric circuit interrupter according to claim 2 wherein the groove is formed so as to have plural crossing portions.

5. An electric circuit interrupter according to claim 2 wherein the groove is formed so as to have plural spiral portions extending from the center of the electrode to peripheral parts of the electrode.

6. An electric circuit interrupter according to claim 2, wherein each said conductive rod is electrically connected to a respective electrode by means of a respective current conductor, and each said electrode is provided with a groove, wherein:

one said current conductor is connected to a respective electrode on a side of the respective groove near the peripheral part of the respective electrode opposite from the side of the respective groove of the respective electrode near the peripheral part thereof to which the other electrode is attached so as to prevent the superposition of the connection points of said current conductors to the electrodes.

7. An electric circuit interrupter according to claim 2, 3, 4 or 5 wherein the electrodes have a conical shape defining a central flat circular top and a slanted surface extending therefrom and the groove extends to said another peripheral part to the slanted surface of the conical shape through said circular flat top.

8. An electric circuit interrupter according to claim 7, further comprising:

the connecting parts connected to each of said conductive rods of said pair of electrodes placed in superposing position; and a concave part formed on the surface of at least one of said electrodes to prevent contact near the connecting part.

9. An electric circuit interrupter according to claim 2, wherein plural grooves are formed in parallel on each electrode so as to form branching current passages between said grooves.

10. An electric circuit interrupter according to claim 2, wherein said current conductor comprises:

a projecting current conductive base formed on one part of an end surface of said conductive rod at a position deviated from the center, said base connected to said electrode; and a reinforcing material for reinforcing the mechanical connection between the remaining part of said end surface and said electrode.

11. An electric circuit interrupter according to claim 9, wherein the relative point of connection of each conductive base to respective electrodes face across the grooves so as to prevent the superposition of the projecting bases.

12. An electric circuit interrupter according to claim 2 wherein said reinforcing material is made of high resistant metal having resistance higher than that of said electrode.

13. An electric circuit interrupter according to claim 9 wherein the grooves are placed perpendicular to the current conductors.

14. An electric circuit interrupter according to claim 2, comprising:

plural curved grooves, each having a predetermined respective curvature.

15. An electric circuit interrupter according to claim 2, comprising:

said at least one electrode having plural grooves cut therethrough, each groove defining a right angle bend.

* * * * *